US008360808B2

(12) United States Patent
Tsuchiya

(10) Patent No.: US 8,360,808 B2
(45) Date of Patent: Jan. 29, 2013

(54) CIRCUIT BOARD MOUNTED CONNECTOR

(75) Inventor: Kazuhiko Tsuchiya, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/175,182

(22) Filed: Jul. 1, 2011

(65) Prior Publication Data

US 2012/0003873 A1 Jan. 5, 2012

(30) Foreign Application Priority Data

Jul. 5, 2010 (JP) ..... 2010-153084

(51) Int. Cl.
*H01R 13/648* (2006.01)

(52) U.S. Cl. ..... 439/607.55; 439/607.27; 439/607.35; 439/607.53

(58) Field of Classification Search ..... 439/607.09, 439/607.27, 607.35, 607.53, 607.54, 607.55
See application file for complete search history.

(56) References Cited

U.S. PATENT DOCUMENTS 5,035,651 A * 7/1991 Dixon et al. ..... 439/607.17
5,041,022 A * 8/1991 Sekiguchi ..... 439/607.17
6,764,338 B2 * 7/2004 Fang ..... 439/607.2
6,997,748 B1 * 2/2006 Su ..... 439/607.55
7,008,266 B2 * 3/2006 Fang ..... 439/607.35
7,731,534 B1 * 6/2010 Yuan et al. ..... 439/607.4
7,771,235 B2 * 8/2010 Kameyama ..... 439/607.27
2006/0052005 A1 * 3/2006 Zhang et al. ..... 439/607
2010/0022132 A1 * 1/2010 Wang ..... 439/607.27
2012/0003873 A1 * 1/2012 Tsuchiya ..... 439/607.01

FOREIGN PATENT DOCUMENTS

JP 2009-064716 A 3/2009

* cited by examiner

*Primary Examiner* — James Harvey
(74) *Attorney, Agent, or Firm* — Sughrue Mion, PLLC

(57) ABSTRACT

A circuit board mounted connector includes an exterior shield shell and a housing assembly. The exterior shield shell has a first face to be mounted on a circuit board to define an electromagnetic shielding space and a second face which is orthogonal to the first face and is opened for installation of a mating connector. The housing assembly is fitted in the exterior shield shell so that the mating connector is connected thereto. The housing assembly includes a connecting terminal member, an interior housing, an interior shield shell, and an exterior housing. The exterior shield shell includes an assembly mounting opening through which the housing assembly is installed into the exterior shield shell, in the first face of the exterior shield shell.

5 Claims, 12 Drawing Sheets

PRIOR ART

PRIOR ART

PRIOR ART

CIRCUIT BOARD MOUNTED CONNECTOR

BACKGROUND

The present invention is related to a circuit board mounted connector which has an anti-noise shield shell and which is mounted on a circuit board.

FIGS. 11 to 13 show a circuit board mounted connector disclosed in Patent Document 1 below.

This circuit board mounted connector 101 includes an exterior shield shell 111 and a housing assembly 121.

The exterior shield shell 111 is mounted on a circuit board, not shown, at a lower surface 112, which is one of surfaces thereof, and defines an electromagnetic shielding space 114 between the circuit board and itself as is shown in FIG. 12. The exterior shield shell 111 is opened in a front surface 113, which is one of side surfaces which are at right angles to a surface of the circuit board, for installation of a mating connector.

The housing assembly 121 is fitted and installed in the exterior shield shell 111. The mating connector is inserted form an opening portion in one side of the exterior shield shell so as to fitted and connected to the housing assembly 121.

As is shown in FIG. 12, the housing assembly 121 includes connecting terminal members 122 which each function as a reed terminal 122*a* which is connected to a contact on the circuit board at one end and at the other end as a connector terminal 122*b* which is fitted and connected to a connecting terminal of the mating connector, an interior housing 123 formed of an insulation resin which accommodates the connecting terminal members 122, an interior shield shell 125 which covers an outer circumference of the interior housing 123 and which is connected with a corresponding shield member of the mating connector for conduction and an exterior housing 126 formed of an insulation resin which accommodates and holds the interior shield shell 125.

Arrows A shown in FIG. 11 indicate an inserting direction in which the mating connector is inserted into the circuit board mounted connector 101, and the inserting direction is parallel to the surface of the circuit board.

In the case of the circuit board mounted connector 101, initially, the exterior shield shell 111 is molded into a shape shown in FIG. 13. Namely, the exterior shield shell 111 is molded into a shape in which a wall member 116 constituting a back wall which confronts the opened front surface 113 extends in the direction of an extension of an upper wall 117 so as to open a back side thereof as is shown in FIG. 13. This wall member 116 is bent in a direction indicated by an arrow B in FIG. 13 after the housing assembly 121 is fitted and installed in an interior of the exterior shield shell 111 from the back side of the exterior shield shell 111 and holds the housing assembly 121 which is now installed in the exterior shield shell 111.

When the housing assembly 121 is fitted and installed in the exterior shield shell 111, as is shown in FIGS. 11 and 13, elongated projections 126*a* which are provided to project on outer side surfaces of the exterior housing 126 are brought into engagement with cutouts 118 formed in corresponding positions on the exterior shield shell 111 so as to guide the housing assembly 121 in an inserting direction.

The above is what is substantially shown by the IDS Japanese Patent Publication No. 2009-64716 A.

SUMMARY

In the fabrication process of the circuit board mounted connector 101 of Patent Document 1, the wall member 116, which constitutes the back wall of the exterior shield shell 111, has to be bent after the housing assembly 121 is fitted and installed in the exterior shield shell 111, and this bending work takes some labor hours, leading to a problem that the fabrication workability is not good.

In addition, a large load is exerted on the exterior shield shell 111 when the wall member 116 is bent, and therefore, a deformation is generated from time to time in a inner wall surface of the exterior shield shell 111. There are fears that the deformation of the exterior shield shell 111 calls for a drawback of connection failure when the mating connector is fitted and connected.

It is therefore one advantageous aspect of the present invention to provide a circuit board mounted connector which has good fabrication workability, which calls for no deformation in an inner wall surface of an exterior shield shell at the time of fabrication and which can obtain highly accurate fabricated conditions.

According to one advantage of the invention, there is provided a circuit board mounted connector, comprising:

an exterior shield shell, having a first face which is configured to be mounted on a circuit board to define an electromagnetic shielding space between the circuit board and the first face and a second face which is orthogonal to the first face and is opened for installation of a mating connector; and a housing assembly, fitted in the exterior shield shell, so that the mating connector is connected thereto from one side of the exterior shield shell, and including:

- a connecting terminal member, having one end which is a reed terminal configured to be connected to the circuit board and the other end which is a connector terminal configured to be connected to a connector terminal of the mating connector;
- an interior housing, made of an insulation resin, and accommodating the connecting terminal member;
- an interior shield shell, covering an outer circumference of the interior housing, and configured to be electrically connected with a corresponding shield member of the mating connector; and
- an exterior housing, made of an insulation resin, and accommodating and holding the interior shield shell, wherein the exterior shield shell includes an assembly mounting opening through which the housing assembly is installed into the exterior shield shell, in the first face of the exterior shield shell.

The circuit board mounted connector may further comprising: a cutout portion, communicating between an inner surface and an outer surface of the exterior shield shell at a position which is visible from an outside of the exterior shield shell; and an engagement confirmation projection, projected from an outer surface of the exterior housing, and fitted to the cutout portion in a state where the housing assembly is fitted in the exterior shield shell.

The assembly mounting opening may be disposed apart from the second face. A connection wall connecting faces of the exterior shield shell, which are orthogonal to both the first face and the second face, may be provided at a part of the first face of the exterior shield shell connected to the second face. The connection wall may perform as a housing supporting the mating connector.

Spring pieces may be projected from inner surfaces of faces of the exterior shield shell, which are orthogonal to both the first face and the second face, at a positions closer to the second face so as to urge side faces of the mating connector inserted in the exterior shield shell. Faces of the exterior housing facing a part of the inner surfaces of the exterior shied where the spring pieces are projected may be formed apart from the part of the inner surfaces so as not to contact the spring pieces.

The circuit board mounted connector may further comprising elastic guide pieces, extended on inner surfaces of faces of the exterior shield shell, which are orthogonal to both the first face and the second face, along an inserting direction of the exterior housing into the exterior shield shell, and urging opposite faces of the exterior housing inserted into the exterior shield shell so as to position the exterior housing at a center position in a widthwise direction of the exterior shield shell.

DETAILED DESCRIPTION OF EXEMPLIFIED EMBODIMENTS

Hereinafter, an embodiment of a circuit board mounted connector according to the invention will be described in detail by reference to the drawings.

Figure 1:
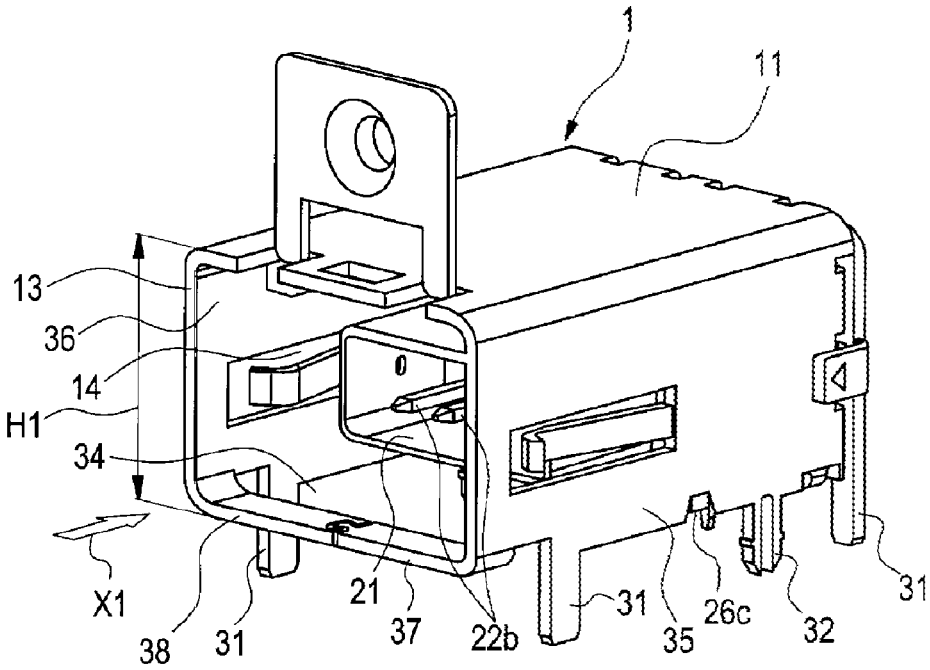
FIG. 1 is a perspective view of an embodiment of a circuit board mounted connector according to the invention.
Figure 2:
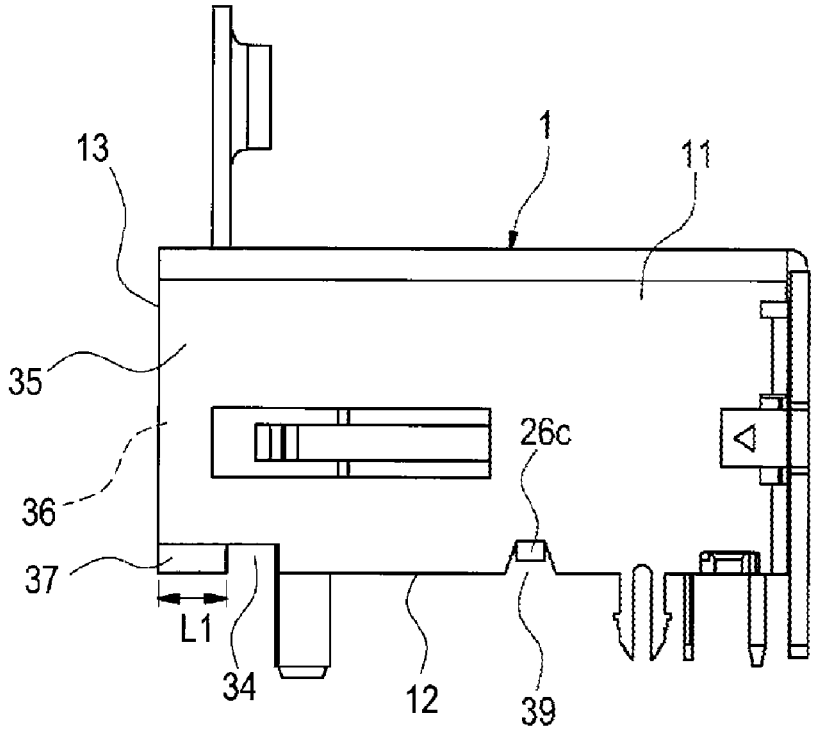
FIG. 2 is a side view of the circuit board mounted connector shown in FIG. 1.
Figure 3:
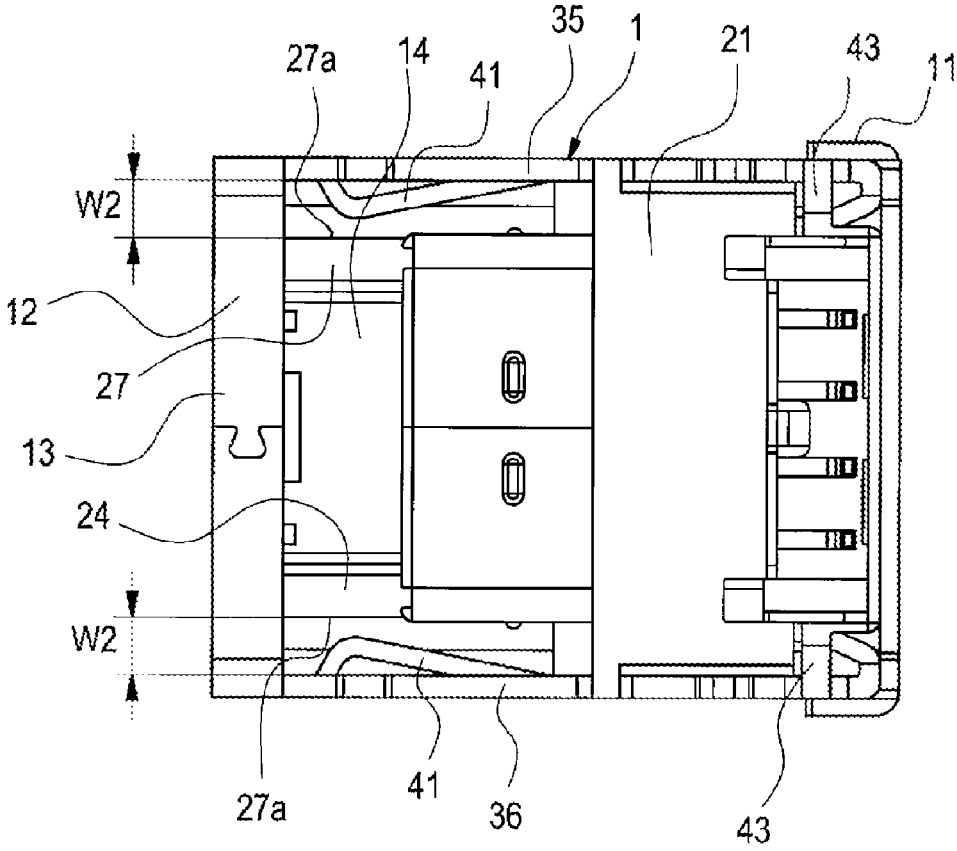
FIG. 3 is a bottom view of the circuit board mounted connector shown in FIG. 1.
Figure 4:
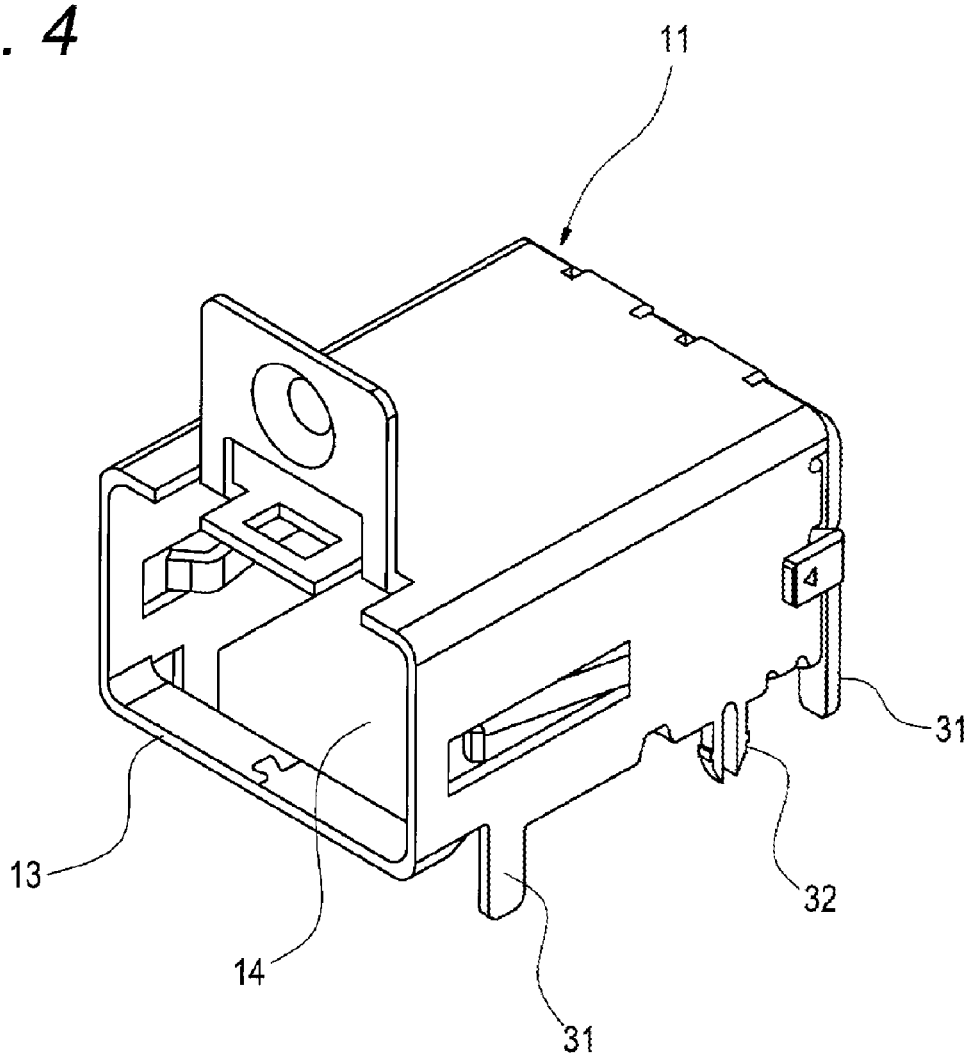
FIG. 4 is a perspective view of an exterior shield shell of the embodiment.
Figure 5:
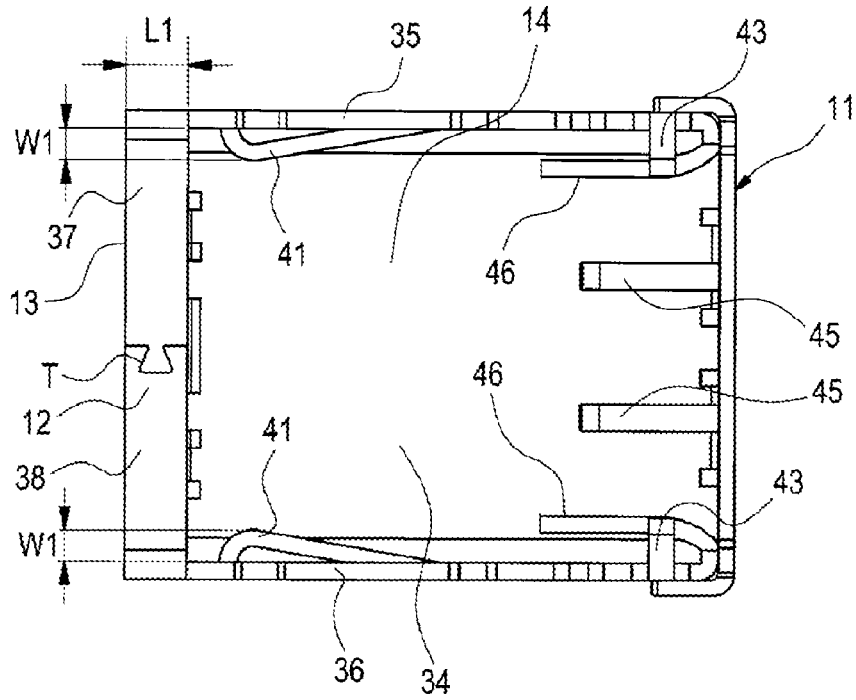
FIG. 5 is a bottom view of the exterior shield shell shown in FIG. 4.

FIGS. 1 to 10 show an embodiment of a circuit board mounted connector according to the invention. FIG. 1 is a perspective view of an embodiment of a circuit board mounted connector according to the invention. FIG. 2 is a side view of the circuit board mounted connector shown in FIG. 1. FIG. 3 is a bottom view of the circuit board mounted connector shown in FIG. 1. FIG. 4 is a perspective view of an exterior shield shell of the embodiment. FIG. 5 is a bottom view of the exterior shield shell shown in FIG. 4.

Figure 6:
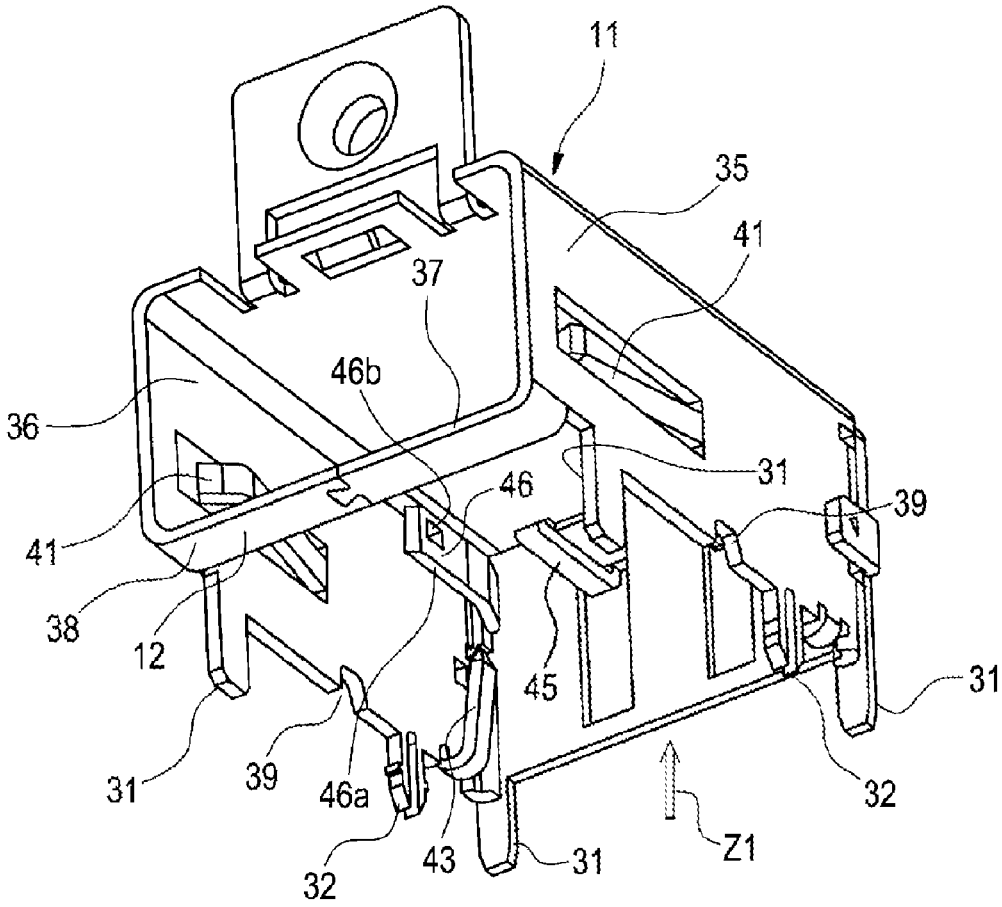
FIG. 6 is a perspective view of the exterior shield shell shown in FIG. 4 which results when it is seen from a bottom side thereof.
Figure 7:
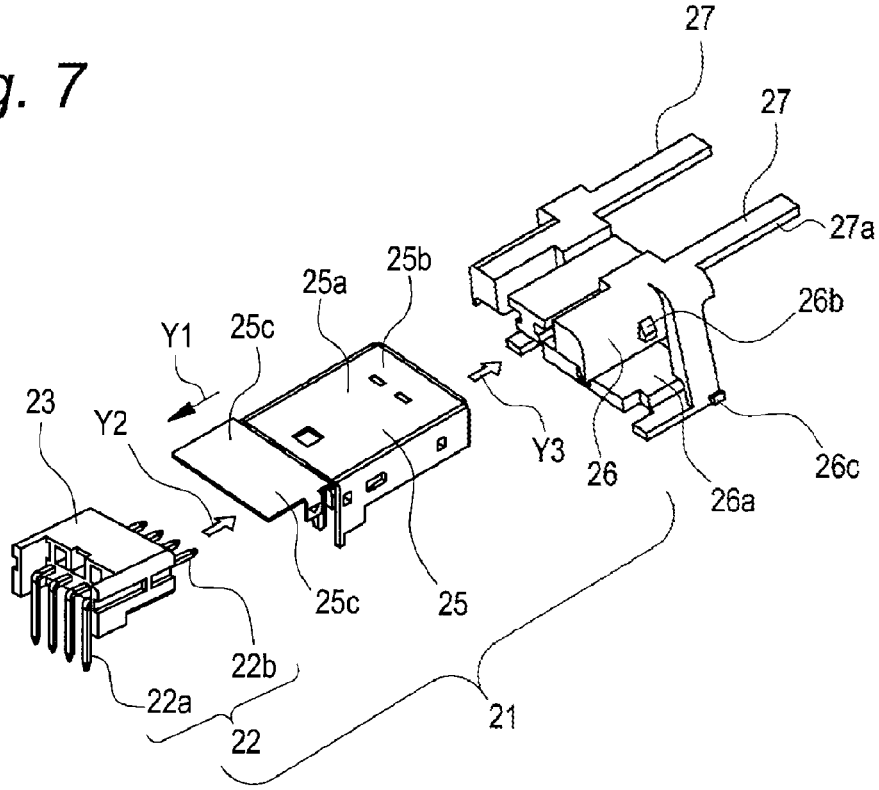
FIG. 7 is an exploded perspective view of a housing assembly in the circuit board mounted connector of the embodiment.
Figure 8:
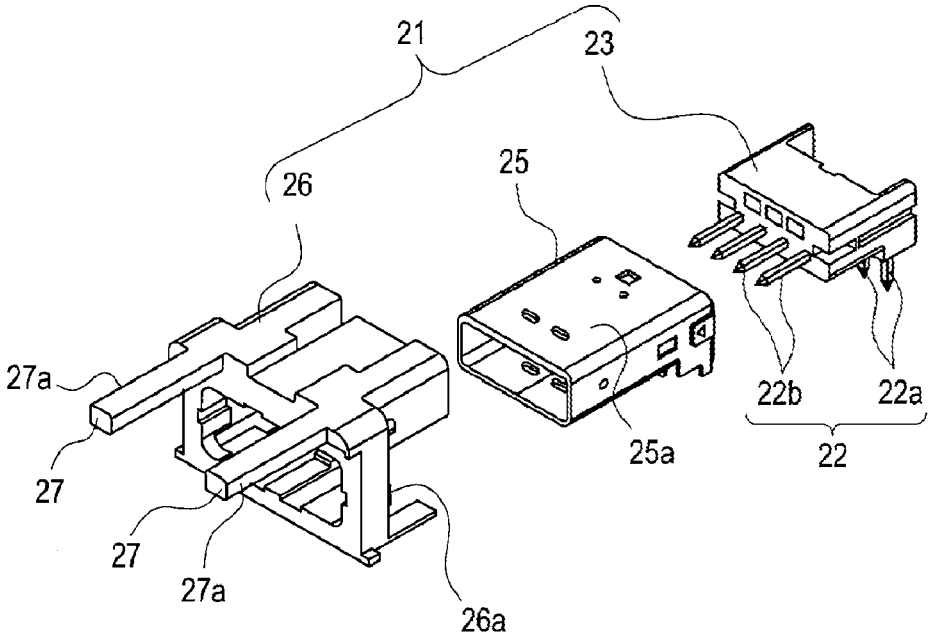
FIG. 8 is an exploded perspective view of the housing assembly of the embodiment shown in FIG. 7 which results when it is seen from an opposite side to a side from which the housing assembly is seen in FIG. 7.
Figure 9:
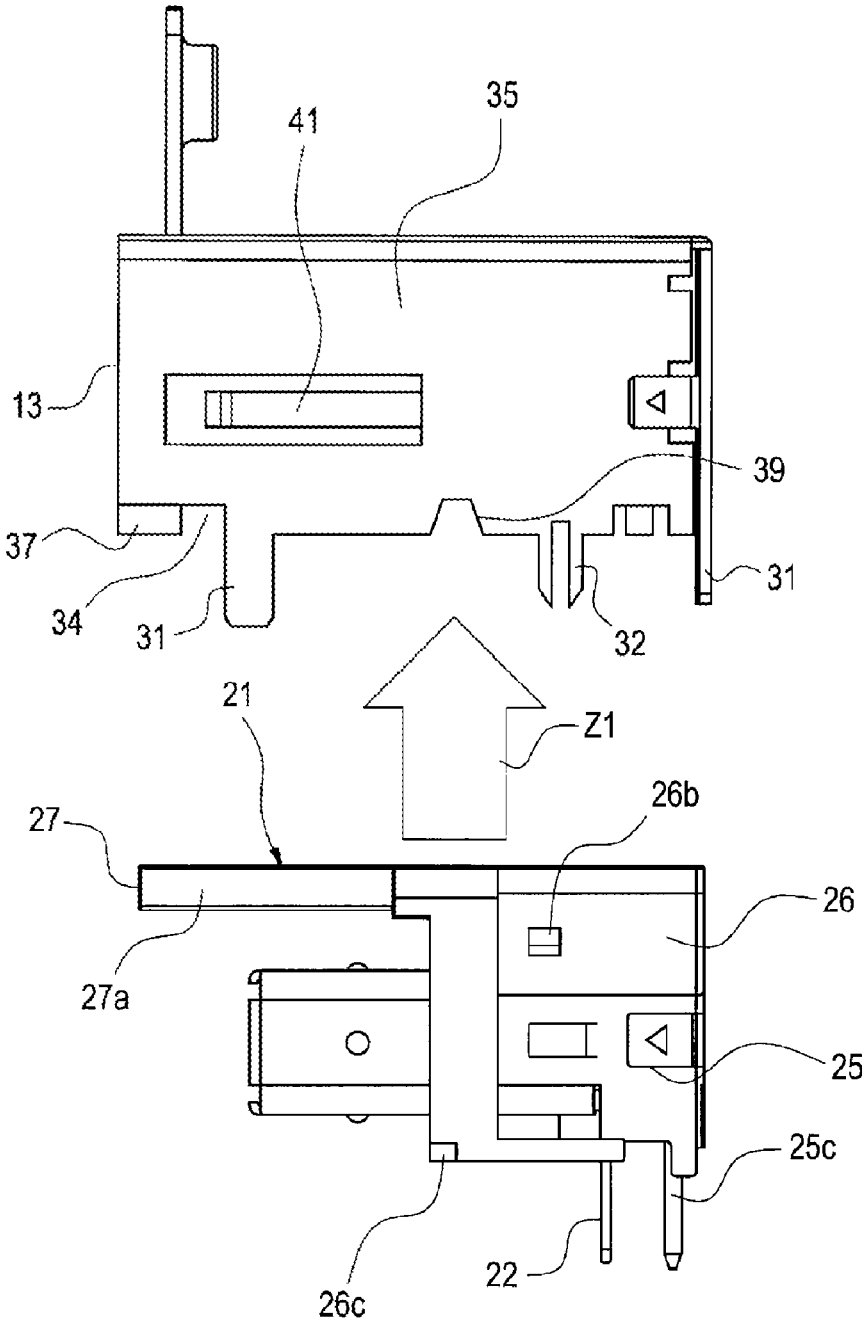
FIG. 9 is an explanatory diagram showing a fabrication process of the circuit board mounted connector of the embodiment.
Figure 10:
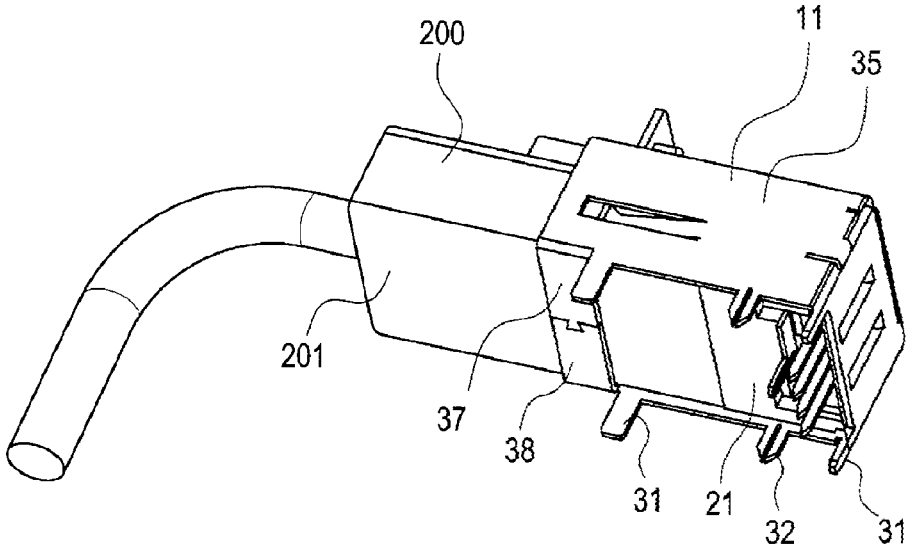
FIG. 10 is a perspective view showing a state in which a mating connector is fitted to be connected to the circuit board mounted connector of the embodiment.
Figure 11:
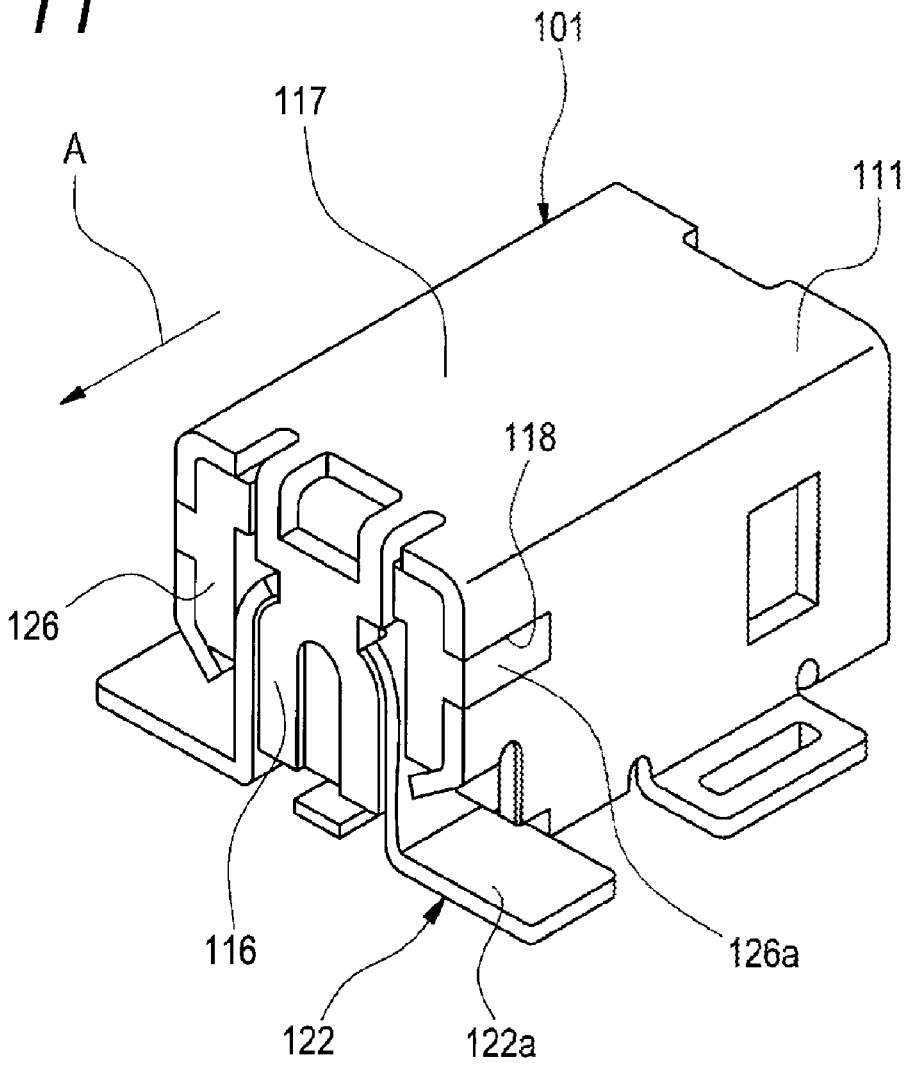
FIG. 11 is a perspective view of a conventional circuit board mounted connector.
Figure 12:
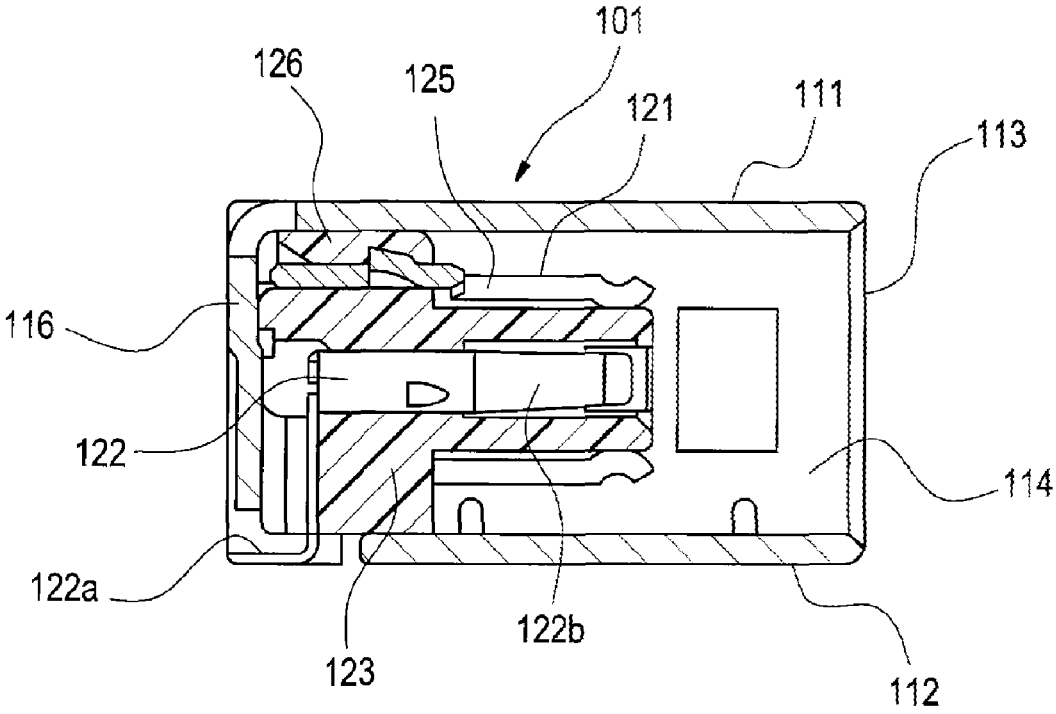
FIG. 12 is a vertical sectional view of the circuit board mounted connector shown in FIG. 11.
Figure 13:
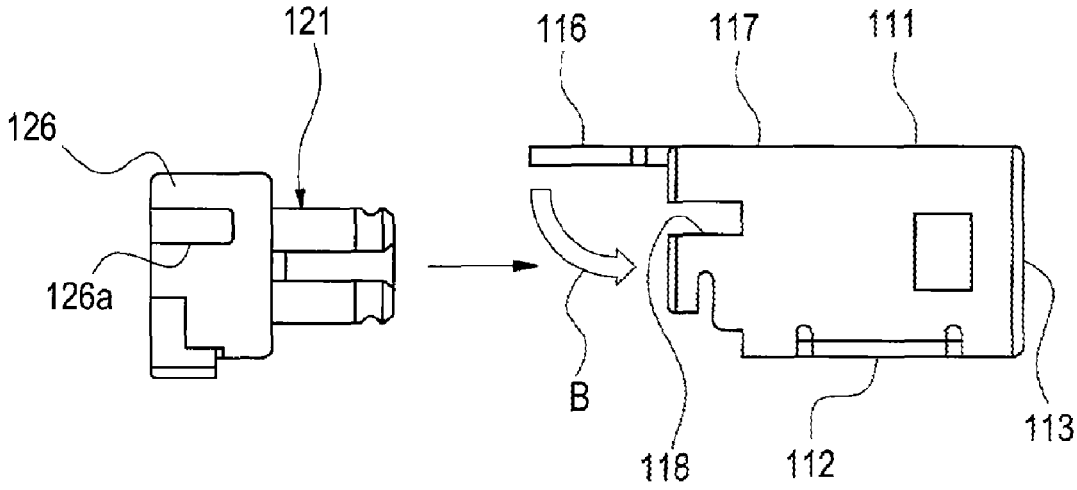
FIG. 13 is an explanatory diagram showing a fabrication process of the circuit board mounted connector shown in FIG. 12.

In addition, FIG. 6 is a perspective view of the exterior shield shell shown in FIG. 4 which results when it is seen from a bottom side thereof. FIGS. 7 and 8 are exploded perspective views of a housing assembly in the circuit board mounted connector of the embodiment. FIG. 9 is an explanatory diagram showing a fabrication process of the circuit board mounted connector of the embodiment. FIG. 10 is a perspective view showing a state in which a mating connector is fitted to be connected to the circuit board mounted connector of the embodiment.

A circuit board mounted connector 1 of this embodiment includes an exterior shield shell 11 and a housing assembly 21.

The exterior shield shell 11 is a pressed part which is pressed out of sheet metal, and as is shown in FIGS. 4 to 6, a lower surface 12 which is one of surfaces thereof constitutes a mounting surface where the exterior shield shell 11 is mounted on a circuit board, not shown. The exterior shield shell 11 is mounted on the circuit board so as to define an electromagnetic shielding space 14 between the circuit board and itself. In addition, in the exterior shield shell 11, a front surface 13 (a second face), which constitutes one side surface which is at right angles to a surface of the circuit board, is opened for installation of a mating connector. An arrow X1 shown in FIG. 1 denotes a direction in which the mating connector is inserted into the exterior shield shell 11.

As is shown in FIGS. 4 and 6, leg portions 31 adapted to be fitted in mounting holes formed in the circuit board and dislodgement preventive locking pieces 32 are provided on a lower surface 12 side of the exterior shield shell 11 so as to project therefrom towards the circuit board.

In the case of this embodiment, the exterior shield shell 11 includes, as is shown in FIG. 5, an assembly mounting opening 34 in the mounting surface, that is the lower surface 12 (a first face) where the exterior shield shell 11 is mounted on the circuit board.

In addition, as is shown in FIG. 5, the assembly mounting opening 34 is set apart by a distance L to the rear from the front surface 13 which is opened for installation of the mating connector. A portion of the lower surface 12 of the exterior shield shell 11 which lies adjacent to the front surface 13 with the distance L defined therebetween is made up of connection walls 37, 38 which connect both side walls 35, 36 of the exterior shield shell 11 together. The pair of connection walls 37, 38 extend from lower ends of both the side walls 35, 36 to a center of the shell along the surface of the circuit board and are connected together with end portions thereof butted against each other. In the case of this embodiment, the end portions of the connection walls 37, 38 which are so butted are joined together through a dovetail joint T as is shown in FIG. 5.

The pair of connection walls 37, 38 guide a bottom surface 201 of the mating connector 200 into an interior of the exterior shield shell 11 and support the bottom surface 201 of the mating connector 200. Thus, the connection walls 37, 38 function as a housing which holds the mating connector 200.

As is shown in FIGS. 5 and 6, spring pieces 41 are formed by being cut out of inner surfaces of both side walls of the exterior shield shell 11 so as to be raised inwards to thereby fasten side surfaces of the mating connector 200 (refer to FIG. 10) which is inserted into the exterior shield shell 11. A projecting length W1 (refer to FIG. 5) is set for each of the spring pieces 41 so that a pressure exerted on the side surface of the mating connector 200 thereby becomes a desired magnitude.

The exterior shield shell 11 includes, as is shown in FIG. 6, cutout portions 39, elastic guide pieces 43, elastic abutment pieces 45 and locking pieces 46 as assisting means for assisting in fitting and installing the housing assembly 21 or positioning means for positioning the housing assembly 21.

The cutout portions 39 are portions with which engagement confirmation projections 26*c* which are provided on an exterior housing 26, which will be described later, when the housing assembly 21 is completely fitted and installed in the exterior shield shell 11. These cutout portions 39 are formed in positions on the exterior shield shell 11 which become visible from exterior portions thereof so as to establish a communication between an inside and an outside of the exterior shield shell 11. The positions where the cutout portions 39 are formed are, specifically, lower edge portions of both the side walls 35, 36 of the exterior shield shell 11.

As is shown in FIGS. 5 and 6, the elastic guide pieces 43 are provided to extend on confronting inner wall surfaces of the exterior shield shell 11 along a fitting direction (a direction indicated by an arrow Z1 in FIG. 6) of the exterior housing 26, which will be described later. The respective elastic guide pieces 43 press both outer side surfaces of the exterior housing 26, which will be described later, when it is inserted into the exterior shield shell 11 from the assembly mounting opening 34 and position the exterior housing 26 so inserted widthwise centrally within the exterior shield shell 11.

When the housing assembly 21 is completely fitted and installed in the exterior shield shell 11, the elastic abutment pieces 45 are brought into elastic abutment with an upper end face of the exterior housing, to be described later, which they confront in the fitting direction, so as to bias the housing assembly 21 towards the assembly mounting opening 34.

The locking pieces 46 are each constructed so that a locking hole 46*b* is provided in a distal end side of an elastic piece 46*a*. When the housing assembly 21 is completely fitted and installed in the exterior shield shell 11, the locking pieces 46 are brought into engagement with engagement projections 26*b* of the exterior housing 26, which will be described later, so as to fix the housing assembly 21 in place.

Next, the housing assembly will be described.

As is shown in FIG. 9, the housing assembly 21 is fitted and installed in the exterior shield shell 11 from the assembly mounting opening 34. As is shown in FIG. 10, the mating connector 200 which is inserted from the opening portion in the one side of the exterior shield shell 11 is fitted and installed in the housing assembly 21.

As is shown in FIGS. 7 and 8, the housing assembly 21 includes connecting terminal members 22 which each function as a reed terminal 22*a* which is connected to a contact on the circuit board at one end and at the other end as a connector terminal 22*b* which is fitted and connected to a connecting terminal of the mating connector, an interior housing 23 formed of an insulation resin which accommodates the connecting terminal members 22, an interior shield shell 25 which covers an outer circumference of the interior housing 23 and which is connected with a corresponding shield member of the mating connector for conduction and the exterior housing 26 formed of an insulation resin which accommodates and holds the interior shield shell 25.

The interior housing 23 has a substantially rectangular shape in a cross section which is at right angles to an inserting direction of the connecting terminals 22.

The interior shield shell 25 includes an angular cylindrical portion 25*a* which has a cross-sectional shape corresponding to the cross-sectional shape of the interior housing 23 and a bending wall 25*c* which extends rearwards (in the direction of an arrow Y1 in FIG. 7) from an upper wall portion 25*b* of the cylindrical portion 25*a*.

The interior housing 23 is inserted into the cylindrical portion 25*a* of the interior shield shell 25 along the direction of an arrow Y2 in FIG. 7 so as to be accommodated in the cylindrical portion 25*a*.

The bending wall 25*c* of the interior shield shell 25 is bent at right angles to the upper wall portion 25*b* after the interior housing 23 is accommodated in an interior of the cylindrical portion 25*a* and covers the rear of the reed terminals 22*a*.

The interior shield shell 25 is inserted into a shell accommodation portion (a recess portion) 26*a* in the exterior housing 26 along the direction of an arrow Y3 in FIG. 7 to thereby be accommodated in the exterior housing 26.

The interior shield shell 25 which now accommodates and holds the interior housing 23 is then accommodated and held in the shell accommodation portion 26*a* of the exterior housing 26, whereby the housing assembly 21 is completely fabricated which is to be fitted and installed in the exterior shield shell 11.

In the case of the circuit board mounted connector of this embodiment, the housing assembly 21, which is now completely fabricated, is inserted into the assembly mounting opening 34 along the direction of an arrow Z1 from below the exterior shield shell 11 as is shown in FIG. 9 to thereby be fitted and installed in the exterior shield shell 11.

As is shown in FIG. 9, engagement projections 26*b* and engagement confirmation projections 26*c* are provided on both outer side surfaces of the exterior housing 26 which is held by the side walls 35, 36 of the exterior shield shell 11.

The engagement projections 26*b* are locked in the locking holes 46*b* in the locking pieces within the exterior shield shell 11 when the exterior housing 26 is inserted to a predetermined position in the exterior shield shell 11 to thereby be completely fitted and installed therein. The housing assembly 21 is fixed in place within the exterior shield shell 11 when the engagement projections 26*b* are locked by the locking pieces 46.

When the exterior housing 26 is inserted to a predetermined position in the exterior shield shell 11 to thereby be completely fitted and installed therein, the engagement confirmation projections 26*c* fit in the cutout portions 39 formed in both the side walls 35, 36 of the exterior shield shell 11 as is shown in FIGS. 2 and 9. The engagement confirmation projections 26*c* are provided on the outer surfaces of the exterior housing 26 to project therefrom so as to correspond to the positions on the exterior shield shell 11 where the cutout portions 39 are provided.

Fitting guide portions 27, which project to the front of the exterior housing 26 in a rod-like fashion, are portions which are fitted in the mating connector. An outer side surface 27*a* of the fitting guide portion 27 constitutes a surface which confronts the spring piece 41 provided on the exterior shield shell 11 as is shown in FIG. 9 when the housing assembly 21 is fitted and installed in the exterior shield shell 11. In this embodiment, as shown in FIG. 3, the outer side surface 27*a* of the exterior housing 26 which confronts the spring piece 41 is shaped to be spaced apart by a distance W2 from an inner surface of the side walls 35, 36 of the exterior shield shell 11 so as not to be brought into contact with the spring piece 41 when the housing assembly 21 is installed in the exterior shield shell 11. This spaced-apart distance W2 is set to a larger value than the projecting length W1 over which the spring piece 41 projects from the inner surface of the side walls 35, 36 shown in FIG. 5.

Note that the exterior housing 26 is made relatively small in size so as to be inserted from the assembly mounting opening 34 in the exterior shield shell 11. However, when the lack of rigidity in the exterior housing 26 is concerned about, it is preferable to increase the rigidity by increasing the thickness of the exterior shield shell 11 so that the rigidity of the exterior housing 26 is compensated for by the exterior shield shell 11.

Thus, in the circuit board mounted connector 1 of the embodiment that has been described heretofore, the housing assembly 21 is fitted and installed in the exterior shield shell 11 from the assembly mounting opening 34 which is provided on the mounting surface or lower surface 12 side of the exterior shield shell where the same shell is mounted on the circuit board. Therefore, the labor consuming bending operation of the wall member of the exterior shield shell does not have to be carried out after the housing assembly 21 has been fitted and installed. Because of this, the fabrication workability can be improved.

In addition, the necessity of bending of the wall member is obviated which constitutes a cause for exertion of the large load on the exterior shield shell 11, and therefore, there is caused no such situation that the generation of deformation in the inner wall surface of the exterior shell 11 is called for during fabrication, thereby making it possible to obtain highly accurate fabricated conditions.

In the circuit board mounted connector of the embodiment, even in the event that locking pieces 46 which lock the housing assembly 21 when the housing assembly 21 is fitted into a predetermined position within the exterior shield shell 11 are provided on the inner wall surfaces of the exterior shield shell 11 which are invisible from the exterior portion, the fitting conditions of the housing assembly 21 and the exterior shield shell 11 can easily be confirmed by confirming the engagement conditions between the cutout portions 39 provided in the exterior shield shell 11 and the engagement confirmation projections 26*c* provide to project on the outer circumference of the exterior housing 26, thereby making it possible to eliminate a risk of ignoring the fabrication failure of the housing assembly 21 relative to the exterior shield shell 11.

Further, in the circuit board mounted connector 1 of the embodiment, the opening portion in the exterior shield shell 11 into which the mating connector 200 is fitted is reinforced by the connection walls 37, 38. As is shown in FIG. 10, these connection walls 37, 38 constitute the guide member which guides the bottom surface 201 of the mating connector 200 into the exterior shield shell 11 and function as the housing which supports the bottom surface 201 of the mating connector 200 which is fitted and connected to the housing assembly 21.

Because of this, the mating connector 200 can firmly be held without extending the exterior housing 26 formed of the insulation resin near the opening portion in the front surface 13 of the exterior shield shell 11.

In addition, the exterior housing 26 does not have to be extended near the opening portion in the exterior shield shell 11, and therefore, the height-wise dimension H1 (refer to FIG. 1) of the exterior shield shell 11 at the portion near the opening portion can be suppressed to a minimum level in which the thickness of the exterior shield shell 11 is added to the height-wise dimension of the mating connector, thereby making it possible to realize a reduction in the height-wise dimension of the circuit board mounted connector.

Further, in the circuit board mounted connector of the embodiment, the spring pieces 41 which hold the mating connector 200 are provided on the inner wall surfaces of the exterior shield shell 11. However, the outer side surfaces 27*a* of the fitting guide portions 27 of the exterior housing 26 which confront the spring pieces 41 are shaped to be spaced apart by the spaced-part distance W2 from the inner wall surfaces of the exterior shield shell 11, as is shown in FIG. 3, so that the outer side surfaces 27*a* of the fitting guide portions 27 are not brought into contact with the spring pieces 41 when the housing assembly 21 is fitted and installed in the exterior shield shell 11.

Consequently, when the housing assembly 26 is fitted and installed in the exterior shield shell 11, the outer side surfaces 27*a* of the exterior housing 26 do not interfere with the spring pieces 41 which are provided on the inner surfaces of the side walls of the exterior shield shell 11 so as to project therefrom. Consequently, the spring pieces 41 on the inner surfaces of the side walls of the exterior shield shell 11 can be prevented from being damaged while the housing assembly 21 is fitted and installed in the exterior shield shell 11 in an ensured fashion.

Further, in the circuit board mounted connector of the embodiment, the exterior housing 26 which is inserted into the exterior shield shell 11 from the assembly mounting opening 34 is positioned widthwise centrally in the exterior shield shell 11 by the pressing force exerted by the elastic guide pieces 43 on both the sides as is shown in FIG. 3. Because of this, the exterior housing 26 is made free of looseness, thereby making it possible to insert the housing assembly 21 into the exterior shield shell 11 in a smooth fashion.

Further, in the circuit board mounted connector of the embodiment, when the housing assembly 21 is completely fitted and installed in the exterior shield shell 11, the elastic abutment pieces 45 (refer to FIG. 6) which are provided on the exterior shield shell 11 press against the surface (the upper surface) of the exterior housing 26 which they confront in the fitting direction. Therefore, the looseness of the housing assembly 21 in the fitting direction can also be prevented.

Note that the circuit board mounted connector of the invention is not limited to the embodiment that has been described heretofore but can be modified or improved variously as required. In addition, the material, shape, dimensions of the circuit board mounted connector of the invention are not limited to those described in the embodiment but are arbitrary, provided that the object of the invention can be attained by those selected arbitrarily.

What is claimed is:

1. A circuit board mounted connector, comprising:

an exterior shield shell, having a first face which is configured to be mounted on a circuit board to define an electromagnetic shielding space between the circuit board and the first face and a second face which is orthogonal to the first face and is opened for installation of a mating connector; and a housing assembly, fitted in the exterior shield shell, so that the mating connector is connected thereto from one side of the exterior shield shell, and including:

a connecting terminal member, having one end which is a reed terminal configured to be connected to the circuit board and the other end which is a connector terminal configured to be connected to a connector terminal of the mating connector;

an interior housing, made of an insulation resin, and accommodating the connecting terminal member;

an interior shield shell, covering an outer circumference of the interior housing and the connecting terminal member, and configured to be electrically connected with a corresponding shield member of the mating connector; and an exterior housing, made of an insulation resin, and accommodating and holding the interior shield shell, wherein the exterior shield shell includes an assembly mounting opening through which the housing assembly is installed into the exterior shield shell, in the first face of the exterior shield shell.

2. The circuit board mounted connector according to claim 1, further comprising:

a cutout portion, communicating between an inner surface and an outer surface of the exterior shield shell at a position which is visible from an outside of the exterior shield shell; and an engagement confirmation projection, projected from an outer surface of the exterior housing, and fitted to the cutout portion in a state where the housing assembly is fitted in the exterior shield shell.

3. The circuit board mounted connector according to claim 1, wherein the assembly mounting opening is disposed apart from the second face, a connection wall connecting faces of the exterior shield shell, which are orthogonal to both the first face and the second face, is provided at a part of the first face of the exterior shield shell connected to the second face, and the connection wall performs as a housing supporting the mating connector.

4. The circuit board mounted connector according to claim 1, wherein spring pieces are projected from inner surfaces of faces of the exterior shield shell, the inner surfaces of faces being orthogonal to both the first face and the second face, at a positions closer to the second face so as to urge side faces of the mating connector inserted in the exterior shield shell, faces of the exterior housing facing a part of the inner surfaces of the exterior shield where the spring pieces are projected are formed apart from the part of the inner surfaces so as not to contact the spring pieces.

5. The circuit board mounted connector according to claim 1, further comprising:

elastic guide pieces, extended on inner surfaces of faces of the exterior shield shell, the inner surfaces of faces being orthogonal to both the first face and the second face, along an inserting direction of the exterior housing into the exterior shield shell, and urging opposite faces of the exterior housing inserted into the exterior shield shell so as to position the exterior housing at a center position in a widthwise direction of the exterior shield shell.

* * * * *